United States Patent [19]

Brekke

[11] 4,021,147

[45] May 3, 1977

[54] GAS PRESSURE DRIVEN PUMP

[76] Inventor: Carroll E. Brekke, 3255 Juniper Ave., Santa Rosa, Calif. 95401

[22] Filed: Apr. 5, 1976

[21] Appl. No.: 673,379

[52] U.S. Cl. ..... 417/138; 417/142; 417/143; 417/147

[51] Int. Cl.[2] ..... F04F 1/06

[58] Field of Search ..... 417/118, 137, 138, 143, 417/145–147, 211.5, 297.5, 139, 142

[56] References Cited

UNITED STATES PATENTS

| | | | |
|---|---|---|---|
| 1,472,839 | 11/1923 | Hulse | 417/142 |
| 1,826,175 | 10/1931 | Hulse | 417/143 X |
| 2,317,121 | 4/1943 | Thomas | 417/138 X |
| 3,320,970 | 5/1967 | McHenry | 417/138 X |
| 3,915,593 | 10/1975 | Chamberlain | 417/138 |

*Primary Examiner*—William L. Freeh
*Assistant Examiner*—Edward Look
*Attorney, Agent, or Firm*—Phillips, Moore, Weissenberger Lempio & Majestic

[57] ABSTRACT

The invention is concerned with an improvement in a gas pressure driven pump which comprises a vessel, means for introducing a liquid into the vessel, means for preventing reverse flow of the liquid into the liquid introducing means, means for introducing a pressurized gas to the vessel, and means responsive to a gas pressure increase in the vessel for flowing the liquid out of the vessel. The invention is an improved system for controlling the flow of pressurized gas into the vessel responsive to the liquid level therein, which system is substantially independent of the density of the liquid. More specifically the improved system comprises a valve having a first, a second and a third port, the valve providing a first mode in which the first port is in communication with the second port and a second mode in which the first port is in communication with the third port. The second port communicates in both modes with the surrounding outside atmosphere. A first conduit communicates a bottom portion of the vessel at a first position therein and the first port. A second conduit communicates with a top portion of the vessel at a second position therein. Shift means operate responsive to a gas pressure differential between a pair of chambers on opposite sides of a diaphragm or sliding piston shift the valve from the first mode which corresponds to a substantially zero gas pressure differential to the second mode which corresponds to a non-zero gas pressure differential. A respective one of the chambers is in gas flow communication with the first conduit and a respective other of the chambers is in gas flow communication with the second conduit. A third conduit is provided communicating with a third position within the vessel above the first position and generally intermediate the first and second positions and providing a pressure escape path from the vessel to the valve via the first and second ports when the liquid level in the vessel is below the third position, the escape path closing when the liquid level is above the third position. Further, the improved system includes means which prevent gas flow, when the non-zero gas pressure differential exists and the valve is in the second mode, from a pressurized gas source to the lower pressured side of the diaphragm.

12 Claims, 7 Drawing Figures

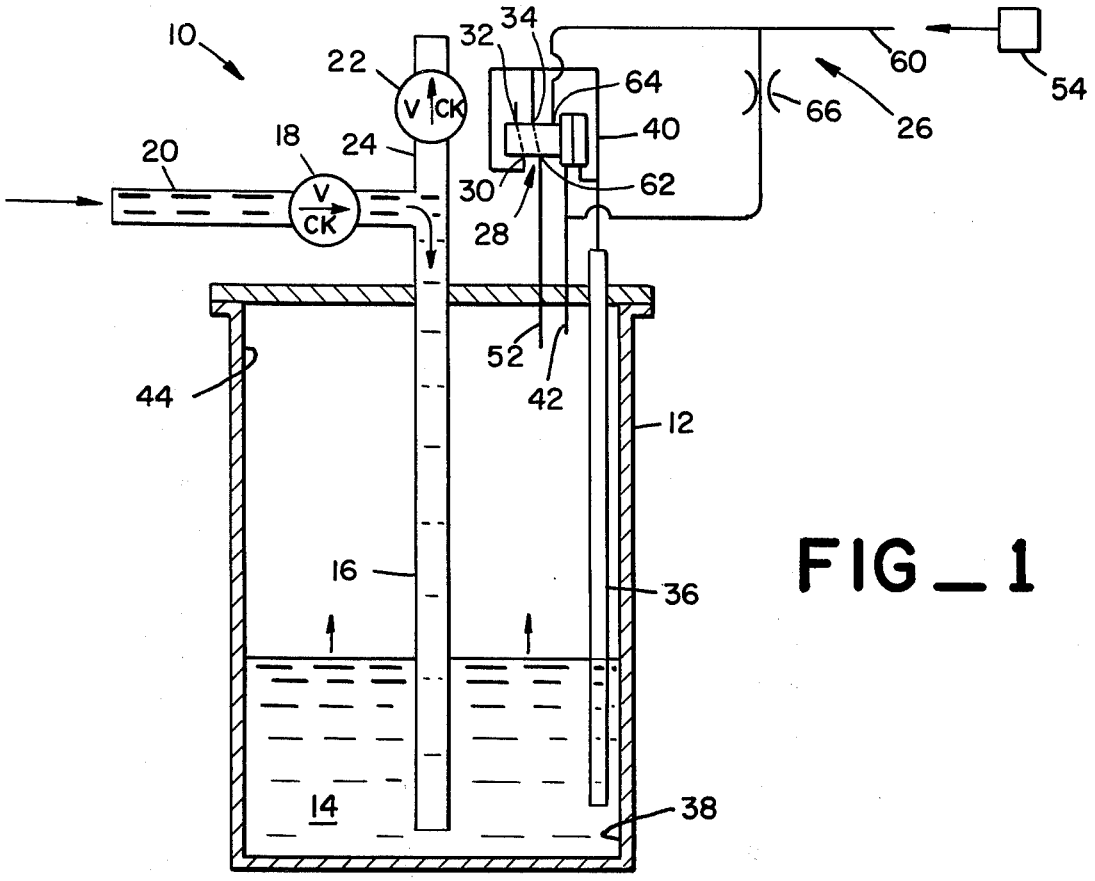
FIG_1
FIG_2
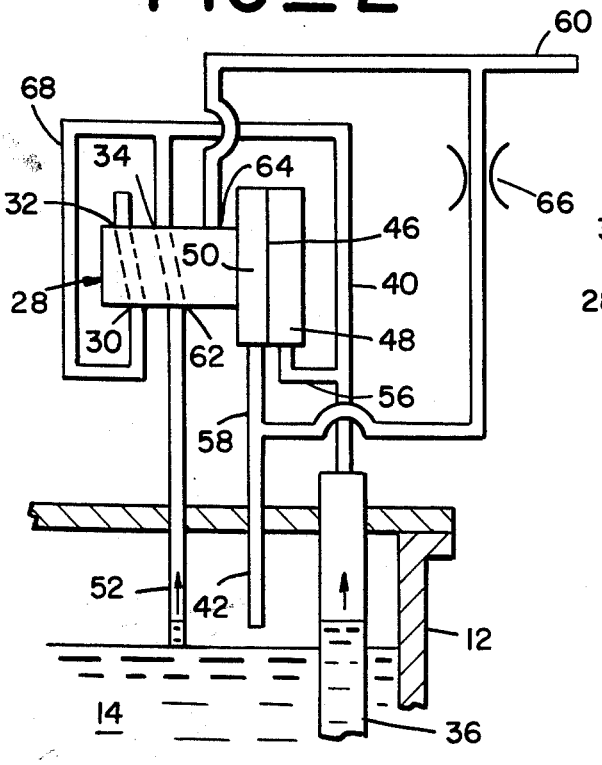
FIG_3
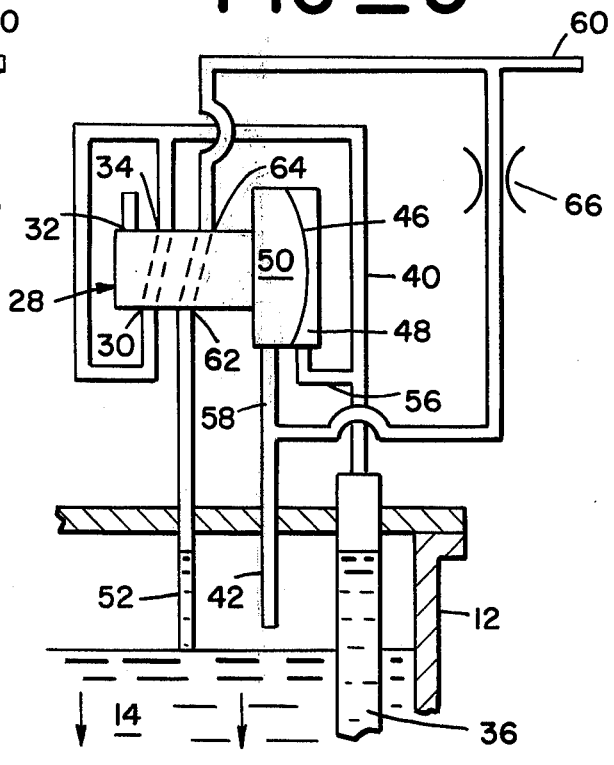

GAS PRESSURE DRIVEN PUMP

BACKGROUND OF THE INVENTION

1. Field of the Invention

The invention is concerned with gas pressure driven pumps useful for transferring liquid from a vessel to another desired location. For example, such pumps are useful in pumping liquid from deep wells. Further, such pumps are useful in pumping liquid along liquid flow lines such as petroleum pipe lines. Still further they are useful as swimming pool pumps wherein the electrical shock hazard can be reduced by placing the electrical portion thereof (the compressor) far from any water. Yet further, they are useful as beverage, e.g., wine, pumps wherein lubrication problems (where the lubricant in normal pumps can contaminate the wine) are eliminated.

2. Prior Art

The prior art teaches a number of pressure differential operated pumping systems. For example, Mingus et al. in U.S. Pat. No. 1,748,361 teach one such system for pumping water or other liquid from a well and assuring that a constant head of water is available. Smith in U.S. Pat. No. 3,082,698 teaches a water head controlled pump which is operated on a pressure differential and which serves to transfer liquid out of a vessel or a tank. Repp in U.S. Pat. No. 3,422,768 teaches an electric switch operated pumping system which operates responsive to the total head of a liquid within a tank.

The present invention provides an improved system which is substantially independent of the density of the liquid therein and which pumps equal volumes of liquid in each stroke thereof and wherein the sensing means used to control said pumping system provides a unique sensitivity along with a protected construction whereby the relatively sensitive elements of the pumping system are all gas pressure operated.

SUMMARY OF THE INVENTION

Briefly, the invention is concerned with an improvement in a gas pressure driven pump which comprises a vessel, means for introducing a liquid into the vessel, means for preventing reverse flow of said liquid into said liquid introducing means, means for introducing a pressurized gas to said vessel, and means responsive to a gas pressure increase in said vessel for flowing said liquid out of said vessel. The improved system is substantially independent of the density of the liquid and serves to control the flow of pressurized gas into the vessel responsive to the liquid level therein. The improved system comprises valve means having a first, a second and a third port, said valve means having a first mode in which said first port is in gas flow communication with said second port and a second mode in which said first port is in gas flow communication with said third port, said second port communicating in both of said first and second modes with the surrounding outside atmosphere. Also part of the improved system are first conduit means communicating a bottom portion of the vessel at a first position therein and said first port and second conduit means communicating with a top portion of the vessel at a second position therein. Also part of the improved system are shift means which operate responsive to a gas pressure differential between a pair of chambers to shift the valve means from the first mode corresponding to a substantially zero gas pressure differential to the second mode corresponding to a non-zero gas pressure differential, a respective one of said chambers being in gas flow communication with said first conduit means and a respective other of said chambers being in gas flow communication with said second conduit means. Third conduit means which communicate with a third position within the vessel above the first position therein and generally intermediate the first and second position and provide a gas pressure escape path from the vessel through the valve means via the first and second ports when the liquid level in the vessel is below the third position, the escape path closing when the liquid level is above the third position, also form a part of the improved system. Further, the improved system includes means preventing gas flow when the non-zero gas pressure differential exists and the valve means is in the second mode from a pressurized gas source to the lower pressured of the pair of chambers.

BRIEF DESCRIPTION OF THE DRAWINGS

The invention will be better understood by reference to the figures of the drawings wherein like numbers denote like parts throughout and wherein:

FIG. 1 illustrates in side section, partially in schematic, a first embodiment of the present invention as the vessel being pumped from is filling;

FIG. 2 illustrates a portion of FIG. 1 just as the vessel has filled and prior to shifting of a valve to cause emptying thereof;

FIG. 3 illustrates in a view similar to FIG. 2, the embodiment of FIG. 1 wherein the vessel has filled and the valve has shifted to begin the pumping cycle therefrom;

DETAILED DESCRIPTION OF THE PREFERRED EMBODIMENTS

Figure 4:
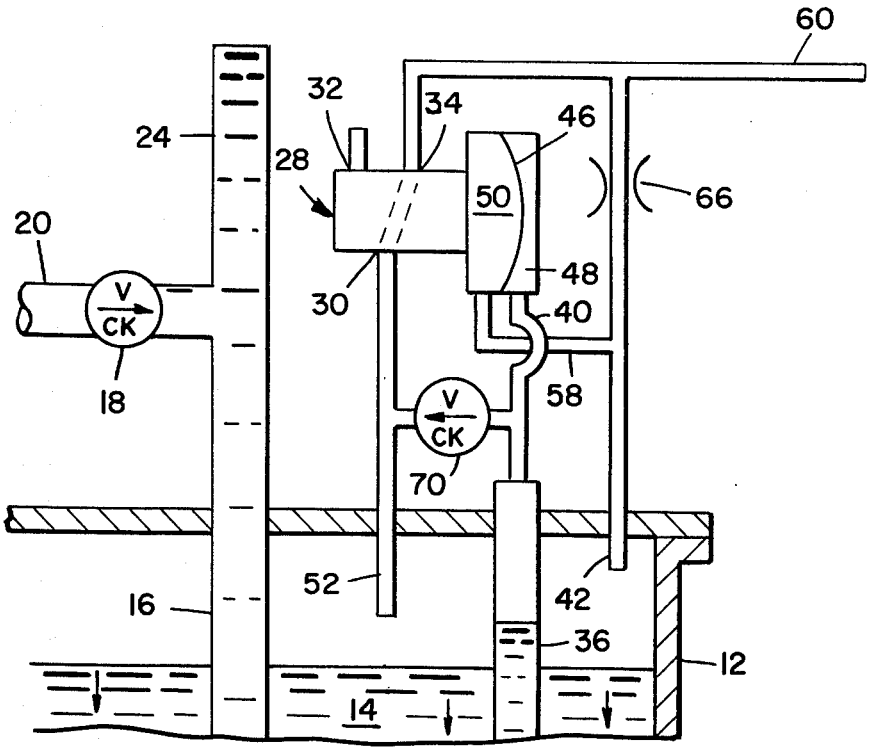
FIG. 4 illustrates an alternate embodiment in the invention during its pumping stroke.

Referring first to FIG. 1 there is illustrated therein a gas pressure driven pump 10 in accordance with the present invention. The pump 10 includes a vessel 12 with a liquid 14 therein. A fill pipe 16 having a one way fill valve 18 therein serves for introducing the liquid 14 into the vessel 12. The one way fill valve 18 prevents reverse flow of the liquid into a liquid introducing means namely a liquid source pipe 20 which communicates via the one way fill valve 18 with the fill pipe 16. A one way emptying valve 22 in a continuing pipe 24 of the fill pipe 16 serves as a means responsive to gas pressure increase in the vessel 12 for flowing the liquid 14 out of the vessel 12. The present invention is particularly concerned with an improved system 26 which is substantially independent of the density of the liquid 14 for controlling the flow of pressurized gas into the vessel 12 responsive to the liquid level therein.

Turning now most particularly to the system 26, it will be seen that said system 26 includes valve means, in the embodiment illustrated in FIGS. 1–3 a valve 28 having a first port 30, a second port 32 and a third port 34. As illustrated in FIG. 1 and in FIG. 2 the valve 28 is in a first mode in which the first port 30 is in gas flow communication within the valve with the second port 32. As illustrated in FIG. 3 the valve 28 also has a second mode in which the first port 30 is in flow communication with the third port 34. In both the first mode and the second mode and as is clear from examination of FIGS. 1–3 the second port 32 communicates with the surrounding outside atmosphere.

First conduit means, in particular a first conduit 36 communicates a bottom portion 38 of the vessel 12 at a first position therein and the first port 30 as represented by line 40. As if further illustrated, second conduit means a more particularly a second conduit 42 communicates with a top portion 44 of the vessel 12.

Shift means, more particularly a diaphragm 46 (in the embodiments illustrated but also alternately a piston within a bore (not illustrated) or the like) operates responsive to a gas pressure differential between a pair of chambers 48 and 50. The diaphragm 46 serves to shift the valve 28 from the previously mentioned first mode corresponding to a substantially zero gas pressure differential between said chambers 48 and 50 to the second mode corresponding to a non-zero gas pressure differential between the chambers 48 and 50. A respective one of the chambers 48 and 50 (in the embodiment illustrated in FIGS. 1–3 the chamber 48) is in gas flow communication with the first conduit 36 and the other of the chambers, namely the chamber 50, is in gas flow communication with the second conduit 42.

Third conduit means, in the embodiment illustrated in FIGS. 1–3 a third conduit 52 communicates with a third position within the vessel above the first position and perhaps as high as the second position but most generally intermediate the first position adjacent the bottom portion 38 of the vessel 12 and the second position adjacent the top portion 44 of the vessel 12. The third conduit 52 provides a gas pressure escape path from the vessel 12 through the valve 28 via the first port 30 and the second port 32 when the level of the liquid 14 in the vessel 12 is below the third position. The escape path closes when the level of the liquid 14 reaches said third position generally within the vessel 12 and is at or above said third position within the third conduit 52. When the liquid level within the third conduit 52 reaches the position shown in FIG. 3, the liquid level exerts a pressure via the second conduit 42 upon the chamber 50 to shift the diaphragm 46.

Means are provided which prevent gas flow when the non-zero gas pressure differential exists and the valve 28 is in the second mode from a pressurzied gas source 54 to the lower pressured of the pair of chambers 48 and 50. In the embodiment illustrated in FIGS. 1–3 the lower pressured of the pair of chambers 48 and 50 comprises the chamber 48 as will be most apparent by reference to FIG. 3. The means which prevents gas flow from the pressurized gas source 54 to the chamber 48 in FIGS. 1–3 comprises the liquid 14 within the vessel 12 and the first conduit 36. It will be further apparent from examination of FIGS. 1–3 that when the non-zero gas pressure differential exists and the valve 28 is in the second mode then the first conduit 36 is in gas flow communication with the lower pressured chamber 48 via the line 40 and a first branch line 56 which proceeds from the line 40 to the chamber 48. At the same time the second conduit 42 is in gas flow communication with the higher pressured chamber 50 via a second branch line 58.

Means are provided as illustrated in FIGS. 1–3 for introducing gas flow from the gas source 54 via the third conduit 52 to the interior of the vessel 12. In the embodiment illustrated, said gas flow introducing means comprises a line 60 from the gas source 54 which communicates with, as illustrated in FIG. 3 most particularly, a fourth port 62 of the valve 28 after passing through a fifth port 64 thereof and proceeding interiorly of the valve 28. The fourth port 62 of the valve 28 communicates with the third conduit 52 and the pressurized gas from the gas source 54 is then introduced into the interior of the vessel 12 via the third conduit 52.

Gas flow restriction means, in the embodiment illustrated an orifice 66 intermediate the gas source 54 and the second conduit 42 serves to provide a controlled leakage of pressure into the top portion 44 of the vessel 12. This serves to compensate for any possible leakage from the chamber 50. In a valve wherein insignificant leakage occurs from the chamber 50 the connection of the line 60 via the orifice to the interior of the vessel 12 can be eliminated.

It will be clear that the third port 34 of the valve 28 is in gas flow communication with the fourth port 62 thereof and the fifth port 64 thereof is blocked in the aforementioned first mode of operation of the valve 28 and that the fourth port 62 of the valve 28 is in the gas flow communication with the fifth port 64 thereof in the aforementioned second mode of operation of the valve 28. It is also clear as previously mentioned that the third conduit 52 communicates with the fourth port 62 to provide a gas fill path into the vessel 12 through the valve 28 in the second mode. For reasons which will soon become apparent fourth conduit means, namely a fourth conduit 68 is provided which communicates the third port 34 of the valve 28 with the first port 30 when the valve 28 is in the aforementioned first mode.

OPERATION OF EMBODIMENT OF FIGS. 1–3

In operation, liquid enters the vessel 12 via the fill pipe 16 as illustrated in FIG. 1. Meanwhile, pressurized gas which may be for example compressed air of steam or the like enters the top portion 44 of the vessel 12 via the restricted orifice 66 and the second conduit 42. The pressurized gas entering the vessel 12 leaves said vessel 12 via the third conduit 52, the fourth port 62, the third port 34, the first port 30 and the second port 32 of the valve 28 with the flow proceeding in the manner just listed. Thus, the leaking of compressed gas into the vessel 12 does not interfere with the filling thereof with the liquid 14.

Once the liquid 14 has reached the level shown in FIGS. 2 and 3, escape of the compressed gas from above the liquid 14 within the vessel 12 is prevented since the third conduit 52, which usually extends below the second conduit 42, becomes blocked off with some of the liquid 14. Pressure thus begins to slowly build up above the liquid 14 as the vessel 12 fills and, via the second branch line 58, pressure also beings to build up in the higher pressure chamber 50 of the pair of chambers 48 and 50. Once sufficient pressure has built up, the diaphragm 46 is forced by the pressure differential across it to move as illustrated in FIG. 3 thus causing the valve 28 to shift to its second mode as illustrated in FIG. 3. In this mode, the gas source 54 is connected directly via the line 60, the fifth port 64, the fourth port 62 and the third conduit 52 with the interior of the vessel 12. The resulting pressure forces the level of the liquid 14 downwardly and forces the liquid 14 itself upwardly within the fill pipe 16 and out of the continuing pipe 24 via the one way emptying valve 22. The pressure across the diaphragm 46 remains sufficient to keep the valve in the second mode of operation since pressure from the gas source 54 is not applied to the chamber 48 until the first conduit 36 has been emptied of the liquid 14 and gas can pass from the interior of the vessel 12 via the first conduit 36 to the chamber 48. When this occurs, the diaphragm 46 is returned to the position shown in FIG. 1 and a liquid fill cycle can begin again with liquid from the liquid source pipe 20 passing via the one way fill valve 18 and the fill pipe 16 into the vessel 12.

FIRST ALTERNATE EMBODIMENT

Referring to FIG. 4, there is illustrated therein a first alternate embodiment of the invention which differs from the embodiment illustrated in FIGS. 1–3 primarily in that a different valve 28 is utilized and in that a checkvalve 70 is provided which allows flow from the line 40, which communicates with the first conduit 36, to the third conduit 52 but does not allow flow in a reverse direction. The valve 28 used in the first alternate embodiment of the invention is of a simpler nature than the valve used in the embodiment illustrated in FIGS. 1–3. The use of the check valve 70 allows a simpler valve 28 to be used. The alternate embodiment shown in FIG. 4 is shown in the pumping cycle. In this cycle, the valve 28 is in its second mode and the first port 30 thereof is connected to the third port 34 thereof. This causes pressure from the line 60 which proceeds from the gas source 54 to be applied within the vessel 12 above the level of the liquid 14. Once the liquid 14 has been emptied from the vessel 12 sufficiently to expose the bottom of the first conduit 36 to the pressure being supplied from the line 60, the third port 34 and the first port 30, then pressure equalizes across the diaphragm 46 whereby the lower pressured chamber 48, as illustrated in FIG. 4, attains the same pressure as the higher pressured chamber 50. Once this occurs, the diaphragm 46 shifts and the valve 28 shifts along with it so as to connect the first port 30 of the valve 28 to the second port 32 thereof. This of course corresponds to the aforementioned first mode of the valve 28. In this mode, gas pressure from the line 60 enters via the orifice 66 and the second conduit 42 into the top of the vessel 12 and exits therefrom via the third conduit 52, the first port 30 and the second port 32 of the valve 28.

It is clear that when the embodiment illustrated in FIG. 4 is in the aformentioned first mode as just described above, no pressure can build up within the vessel 12. Instead, liquid 14 enters the vessel 12 via the liquid source pipe 20, the one way fill valve 18, and the fill pipe 16 just as with the embodiment illustrated in FIGS. 1–3. The level of the liquid 14 then begins to rise and continues to rise until it blocks the third conduit 52. Once that happens, pressure begins to build up due to liquid influx and also to gas introduced via the orifice 66 and the second conduit 42 within the vessel 12. This pressure also builds up on the higher pressure side 50 of the diaphragm 46 via the second branch line 58. A slight build up in pressure is enough to throw the diaphragm 46 righwardly in FIG. 4 whereby the valve 28 is shifted to its second mode. In the second mode the line 60 from the gas source 54 is connected via the third port 34 and the first port 30 of the valve 28 to the third conduit 52 and gas pressure begins to flow into the top of the vessel 12 via the third conduit 52. Thus the cycle is repeated.

The check valve 70 allows flow only from the line 40 and hence from the first conduit 36 to the third conduit 52 while preventing flow in a reverse direction. Thus, the liquid level can rise within the first conduit 36 and gas thereabove will escape via the check valve 70. But, when the third conduit 52 is being pressurized from the line 60 as in the second mode of operation of the valve 28, the pressure from the line 60 which is present in the third conduit 52 cannot and is not applied to the line 40 which communicates with the first conduit 36.

SECOND ALTERNATE EMBODIMENT

Figure 5:
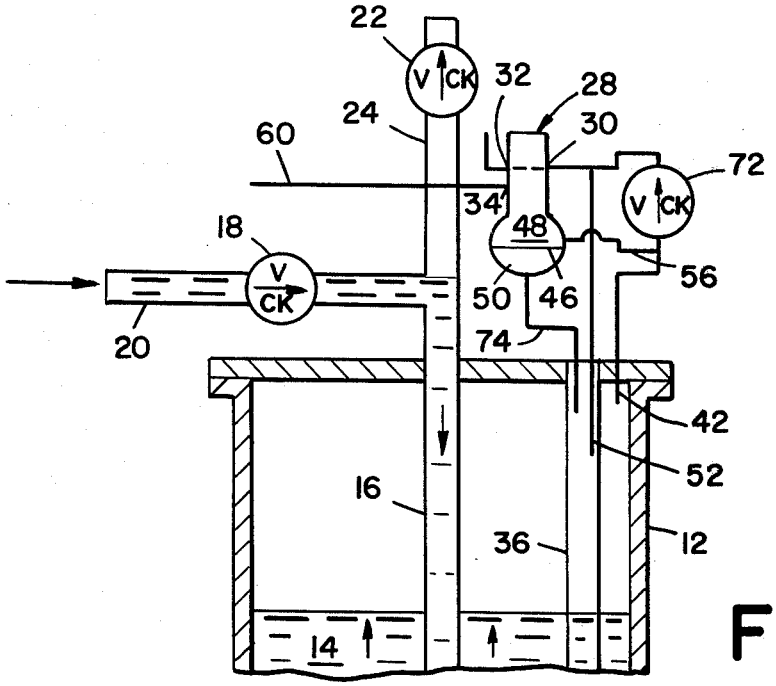
FIG. 5 illustrates another alternate embodiment of the invention in its vessel filling mode.
Figure 6:
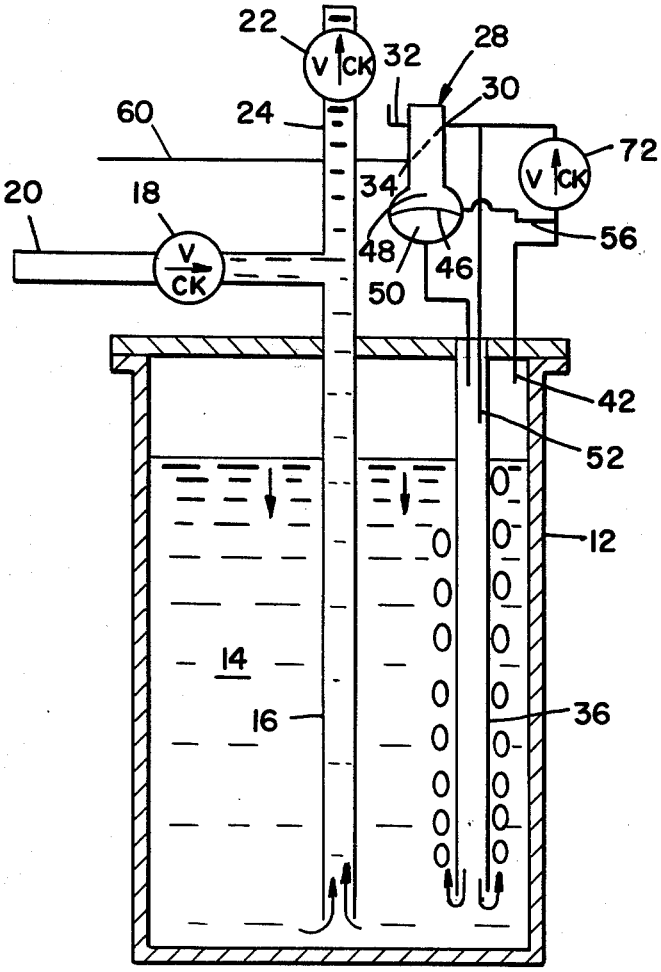
FIG. 6 illustrates the same embodiment as is illustrated in FIG. 5 in its pumping stroke.

Referring to FIGS. 5 and 6 there is illustrated therein a second alternate embodiment of the invention. FIG. 5 illustrates this embodiment with the valve 28 in its first mode of operation whereby the level of the liquid 14 within the vessel 12 is rising and gas pressure is not being applied to the interior of the vessel 12. FIG. 6 illustrates the same embodiment but wherein the level of the liquid 14 is dropping under the impetus of pressure supplied internally to the vessel 12 via the valve 28 which is in FIG. 6 in its second mode.

Considering first FIG. 5 wherein the level of the liquid 14 is rising it is clear that the space above the liquid 14 within the vessel 12 is emptying via the second conduit 42, a one way valve 72, the first port 30 and the second port 32 of the valve 28. Similarly, gas entrapped above the liquid level within the first conduit 36 is escaping via the third conduit 52 which also communicates with the first port 30 of the valve 28. It will be noted that in the embodiment illustrated in FIGS. 5 and 6 the third conduit 52 is within the first conduit 36. It is further clear that in the mode shown in FIG. 5, i.e., the first mode of the valve 28, an equal pressure exists in the chambers 48 and 50 across the diaphragm 46.

Referring now most particularly to FIG. 6 it will be seen that the liquid level has risen sufficiently to block off the third conduit 52 whereby pressure has built up in the chamber 50 via a conduit 74 which communicates between the chamber 50 and the first conduit 36. As soon as this pressure has built up because of air being entrapped between the end of the third conduit 52 and the end of the conduit 74, the diaphragm 46 has been thrown upwardly as is illustrated in FIG. 6. This has resulted in the valve 28 being shifted to its second mode of operation wherein pressure from the line 60 from the gas source 54 passes via the third port 34 and the first port 30 of the valve 28 to the third conduit 52 and thence proceed downwardly within the first conduit 36 and bubbles out of the bottom thereof to fill in the space above the liquid 14 with pressurized gas thus forcing the level of the liquid 14 to drop as the liquid is forced out of the fill pipe 16, the continuing pipe 24 and the one way emptying valve 22. Once the liquid level has fallen low enough so that the second conduit 42 is exposed to the same pressure as is the conduit 74 (to below the bottom of the first conduit 36) the diaphragm 46 returns to the position shown in FIG. 5 and the cycle can begin anew. It is clear that the one way valve 72 serves the very important purpose of allowing flow upwardly through the second conduit 42 while at the same time preventing pressure from the line 60 from being applied to the chamber 48 during the pumping portion of the cycle. It is clear that when the valve means is in its second mode in the second alternate embodiment of the invention, the first conduit 36 is in gas flow communication with the higher pressured chamber 50 of the pair of chambers 48 and 50 and that the second conduit 42 is at the same time in gas flow communication with the lower pressured chamber 48 of the chambers 48 and 50 via the branch line 56.

THIRD ALTERNATE EMBODIMENT

Figure 7:
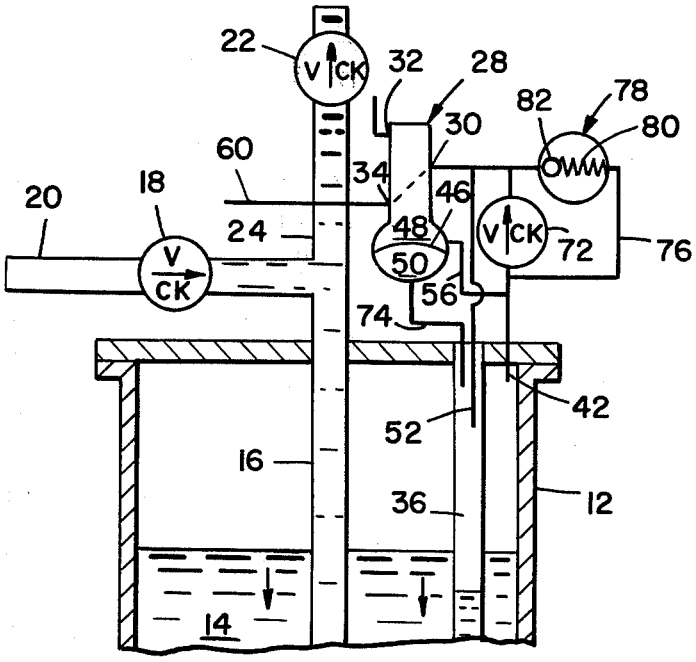
FIG. 7 illustrates yet another alternate embodiment of the invention in its pumping stroke.

Referring now to FIG. 7 there is illustrated therein a third alternate embodiment of the invention in its pumping mode. The third alternate embodiment of the invention closely resembles the second alternate embodiment of the invention as illustrated in FIGS. 5 and 6 with the exception that gas is not introduced to the interior of the vessel 12 to pressurize it and force the liquid 14 to flow out therefrom via the third conduit 52. Instead, a bypass path 76 is provided having therein check valve means, or more particularly a check valve 78 across the one-way valve 72 from the first port 30 of the valve 28 to the second conduit 42. The check valve 78 is biased as by a spring 80 acting against a ball 82 to prevent flow from the first port 30 of the valve 28 to the second conduit 42 until a check valve pressure differential exists which exceeds a value determined by the biasing or more particularly by the strength of the spring 80. The check valve 78 in the usual manner always prevents flow from the second conduit 42 to the first port 30. It is possible to and in fact commercial valves are available which in one unit, carry out the purposes and include the structures of the one-way valve 72, the bypass path 76 and the check valve 78. The value of the biasing by the spring 80 is important and must be a pressure which is lesser than a liquid pressure head equivalent to the height of the first conduit 36 within the vessel 12 and must be greater than a predetermined minimum value of said non-zero gas pressure differential. More specifically, said value must be greater than the minimum gas pressure differential necessary to shift the diaphragm 46 and hence the valve 28. Thus, when the valve 28 is in its second mode as illustrated in FIG. 7 sufficient gas pressure is applied to the check valve 78 to force the spring 80 to unseat the ball 82 whereby flow occurs around the ball 82 and through the bypass path 76 and thence to the interior of the vessel 12. The head of liquid 14 between the interior of the first conduit 36 and the interior of the vessel 12 is a measure of the biasing of the check valve 78. The pressure building up within the vessel 12 via the second conduit 42 causes said liquid 14 to be forced out of the vessel 12 via the line 16 as in other embodiments of the invention. It will be noted that the pressure from the line 60 is likewise applied via the third conduit 52 to the higher pressured chamber 50 of the pair of chambers 48 and 50 via the conduit 74 and at the same time is applied via the branch line 56 to the lower pressured chamber of the pair of chambers 48 and 50. The diaphragm 46 remains flexed upwardly since the original differential in pressure between gas entrapped above liquid within the first conduit 36 and gas above the liquid 14 within the vessel 12 is unchanged. Once the level of the liquid 14 has dropped far enough so as to expose the bottom of the first conduit 36, the pressure equalizes between the second conduit 42 and the third conduit 52 thus equalizing pressure across the diaphragm 46 whereby it returns to its unstressed position and the valve 28 is shifted to its first mode of operation.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. In a gas pressure driven pump which comprises a vessel, means for introducing a liquid into said vessel, means for preventing reverse flow of said liquid into said liquid introducing means, means for introducing a pressurized gas to said vessel, and means responsive to a gas pressure increase in said vessel for flowing said liquid out of said vessel, an improved system substantially independent of the density of said liquid for controlling the flow of pressurized gas into said vessel responsive to the liquid level therein, comprising:

1. valve means having a first, a second and a third port, said valve means having a first mode in which said first port is in gas flow communication with said second port and a second mode in which said first port is in gas flow communication with said third port, said second port communicating in both of said first and second modes with the surrounding atmosphere;
2. first conduit means communicating a bottom portion of said vessel at a first position therein and said first port;
3. second conduit means communicating with a top portion of said vessel at a second position therein;
4. shift means operating responsive to a gas pressure differential between a pair of chambers to shift said valve means from said first mode corresponding to a substantially zero gas pressure differential to said second mode corresponding to a non-zero gas pressure differential, a respective one of said chambers being in gas flow communication with said first conduit means and a respective other of said chambers being in gas flow communication with said second conduit means;
5. third conduit means communicating with a third position within said vessel above said first position and providing a gas pressure escape path from said vessel through said valve means via said first and second ports when the liquid level in said vessel is below said third position, said escape path closing when the liquid level in said third conduit means rises above said third position; and
6. means preventing gas flow from a pressurized gas source when said non-zero gas pressure differential exists and said valve means is in said second mode to the lower pressured of said pair of chambers.

2. An improved pump as in claim 1, including a diaphragm separating said pair of chambers and wherein said valve means shifts responsive to movement of said diaphragm.

3. An improved pump as in claim 2, wherein when said non-zero gas pressure differential exists and said valve means is in said second mode, said first conduit means is in gas flow communication with the lower pressured of said chambers and said second conduit means is in gas flow communication with the higher pressured of said chambers.

4. An improved pump as in claim 3, wherein said valve means includes:

a fourth port and a fifth port, said fifth port being in gas flow communication with said gas source, said third port being in gas flow communication with said fourth port and said fifth port being blocked in said first mode and said fourth port being in gas flow communication with said fifth port in said second mode, said third conduit means communicating with said fourth port to provide a gas fill path into said vessel through said valve means in said second mode; and including fourth conduit means communicating said third port to said first port in said first mode.

5. An improved pump as in claim 4, including means for introducing gas flow from said gas source via said second conduit means to said vessel.

6. An improved pump as in claim 5, including gas flow restriction means intermediate said gas source and said second conduit means.

7. An improved pump as in claim 3, including a conduit from said first means to said third conduit means, said conduit including one-way valve means therein which allows gas to flow in one direction from said first conduit means to said third conduit means and prevents gas from flowing in an opposite direction.

8. An improved pump as in claim 7, including means for introducing gas flow from said gas source via said second conduit means to said vessel.

9. An improved pump as in claim 8, including gas flow restriction intermediate said gas source and said second conduit means.

10. An improved pump as in claim 2, wherein when said non-zero gas pressure differential exists and said valve means is in said second mode said first conduit means is in gas flow communication with the higher pressured to said chambers and said second conduit means is in gas flow communication with the lower pressured of said chambers.

11. An improved pump as in claim 10, wherein: said third conduit means is within said first conduit means; in said second mode said third conduit means provides a gas fill path from said first port to an interior of said first conduit means and thence to said vessel; and said gas source is in gas flow communication with said third port; and including:

a conduit from said second conduit means to said first port including one-way valve means therein which allows gas to flow in one direction from said second conduit means to said first port and prevents gas from flowing in an opposite direction.

12. An improved pump as in claim 10, wherein:

said third conduit means is within said first conduit means;

said second conduit means communicates with a first conduit leading to said first port and includes one-way valve means therein allowing gas to flow in one direction from said vessel to said first port and preventing gas from flowing in an opposite direction;

said pump includes a bypass path across said one-way valve means from said first port to said second conduit means, said bypass path having therein check valve means biased to always prevent flow from said second conduit means to said first port and to prevent flow from said first port to said second conduit means until check valve pressure differential exceeds a valve determined by said biasing, said value being lesser than a liquid pressure head equivalent to the height of said first conduit means within said vessel and being greater than a predetermined minimum value of said non-zero gas pressure differential; and said gas source is in gas flow communication with said third port.

* * * * *

UNITED STATES PATENT AND TRADEMARK OFFICE

CERTIFICATE OF CORRECTION

PATENT NO. : 4,021,147

DATED : May 3, 1977

INVENTOR(S) : CARROLL E. BREKKE

It is certified that error appears in the above-identified patent and that said Letters Patent are hereby corrected as shown below:

Claim 9, line 29 of column 9, after "restriction and before "intermediate" insert --means--.

Claim 10, line 35 of column 9, after "pressured" and before "said" delete "to" and substitute therefor --of--.

Claim 12, line 29 of column 10, after "a" and before "determined" delete "valve" and substitute therefor --value--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*